US010467993B2

(12) United States Patent
Canivell Grifols

(10) Patent No.: US 10,467,993 B2
(45) Date of Patent: Nov. 5, 2019

(54) CONNECTION DEVICE BETWEEN THE NECK AND BODY OF A STRINGED MUSICAL INSTRUMENT AND STRINGED MUSICAL INSTRUMENT CONTAINING SAID DEVICE

(71) Applicant: LLEVINAC, S.L., Barcelona (ES)

(72) Inventor: Jordi Canivell Grifols, Barcelona (ES)

(73) Assignee: LLEVINAC, S.L., Barcelona (ES)

( * ) Notice: Subject to any disclaimer, the term of this patent is extended or adjusted under 35 U.S.C. 154(b) by 14 days.

(21) Appl. No.: 15/545,502

(22) PCT Filed: Jan. 14, 2016

(86) PCT No.: PCT/ES2016/070012
§ 371 (c)(1),
(2) Date: Jul. 21, 2017

(87) PCT Pub. No.: WO2016/116644
PCT Pub. Date: Jul. 28, 2016

(65) Prior Publication Data

US 2018/0012578 A1 Jan. 11, 2018

(30) Foreign Application Priority Data

Jan. 21, 2015 (ES) ..... 201530079

(51) Int. Cl.
*G10D 3/06* (2006.01)
*G10D 1/08* (2006.01)

(52) U.S. Cl.
CPC ..... *G10D 3/06* (2013.01); *G10D 1/08* (2013.01)

(58) Field of Classification Search
CPC ..... G10D 1/08
See application file for complete search history.

(56) References Cited

U.S. PATENT DOCUMENTS 5,469,770 A * 11/1995 Taylor ..... G10D 3/02 84/291
6,265,648 B1 7/2001 Steinberger
(Continued)

FOREIGN PATENT DOCUMENTS

WO 2010/070363 A1 6/2010

OTHER PUBLICATIONS

Search Report dated Jun. 12, 2015 in corresponding ES Application No. 201530079.

*Primary Examiner* — Kimberly R Lockett
(74) *Attorney, Agent, or Firm* — Knobbe, Martens, Olson & Bear, LLP

(57) ABSTRACT

Device for connecting the neck to the body of a stringed musical instrument and stringed musical instrument containing said device
The invention relates to a device for connecting the neck to the body of a stringed musical instrument of the type that comprises a first and second component, it being possible to connect the first component to the neck and said second component to the body of the stringed musical instrument, said first and second components being form-engaged to each other, the device comprising also means for adjusting the contact position of said first component to different angles relative to said second component and in that the device also comprises means for fixing the relative position of said first component to said second component.

12 Claims, 7 Drawing Sheets

(56) References Cited

U.S. PATENT DOCUMENTS

| | | | | |
|---|---|---|---|---|
| 6,831,218 | B2 | 12/2004 | Steinberger | |
| 7,157,634 | B1 | 1/2007 | Babicz | |
| 7,557,281 | B1 * | 7/2009 | Campling | G10D 3/06 84/293 |
| 7,687,698 | B2 | 3/2010 | Kim | |
| 7,875,782 | B1 | 1/2011 | Nechville | |
| 2010/0024623 | A1 | 2/2010 | Kim | |
| 2014/0047968 | A1 * | 2/2014 | Bagale | G10D 1/08 84/267 |

* cited by examiner

CONNECTION DEVICE BETWEEN THE NECK AND BODY OF A STRINGED MUSICAL INSTRUMENT AND STRINGED MUSICAL INSTRUMENT CONTAINING SAID DEVICE

CROSS-REFERENCE TO RELATED APPLICATIONS

This application is the U.S. National Phase under 35. U.S.C. § 371 of International Application PCT/ES2016/070012, filed Jan. 14, 2016, which claims priority to Spanish Patent Application No. 201530079, filed Jan. 21, 2015. The disclosures of the above-described applications are hereby incorporated by reference in their entirety.

The present invention relates to the field of stringed musical instruments, such as guitars, for example, among others.

In particular, the present invention relates to a connection device between the neck and the body of a stringed musical instrument and a stringed musical instrument containing said device.

In the music industry, musicians increasingly demand musical instruments that can be personalised and adapted to the way they play said instruments. Large musical instrument companies often produce made-to-measure musical instruments, such as guitars, for example, specially ordered by well-known musicians. Said well-known musicians sometimes even order some portions of said guitars to be replaced by others in order to experiment with new sounds and/or be better suited to the way said musicians play their guitars. However, for economic reasons, ordering made-to-measure guitars is not always an option for independent musicians who are not so well known. Furthermore, with the guitars currently available commercially it is not possible to exchange portions of said guitars for others, such as the bridge on guitars for another of a different size, for example.

An object of the present invention is to disclose a device that can be used to connect the neck and box of a stringed musical instrument in a way that is efficient, convenient for the user and easily detachable without the intervention of a luthier.

Another object of the present invention is to disclose a stringed musical instrument that comprises said device which can connect the neck and the box.

In particular, the present invention discloses a device for connecting the neck and body of a stringed musical instrument of the type that comprises a first and second component, being optionally connected the first component to the neck and said second component to the body of the stringed musical instrument, said first and second components being form-engaged to each other, characterised in that it also comprises means for adjusting the contact position of said first component relative to said second component to different angles and in that the device also comprises means for fixing the relative position of said first component to said second component. Thus, because the angular position of the neck can be adjusted in relation to the body of the musical instrument, bridges of different sizes can be arranged while always maintaining a constant distance of the strings between the bridge and the centre of the turning circle of the neck, as said centre of the turning circle of the neck is always located at a point that coincides with one of the strings above the neck.

Preferably, said means for adjusting the respective first and second components each have curved toothed surfaces form-engaged to each other.

Preferably, said adjustment means comprise two parts with respective curved toothed contact surfaces that fit together arranged inside said second component, both parts comprising at least one through-hole along which at least one fixing component is arranged, the distal end of which is attached to said first component.

Preferably, said fixing means comprise at least one bolt-type threaded component.

According to another feature of the present invention, a stringed musical instrument is disclosed made up of a box connected to a neck by means of a connection device according to the present invention. In particular, said stringed musical instrument is a guitar.

For a better understanding of the invention, the accompanying drawings show an embodiment of the present invention as an explanatory and non-limiting example.

FIGS. 1 to 7 show various features of the present invention in a stringed musical instrument, such as a guitar 1 for example made up of a body or box 11 and a neck 12 finishing with a headstock 13.

Figure 3:
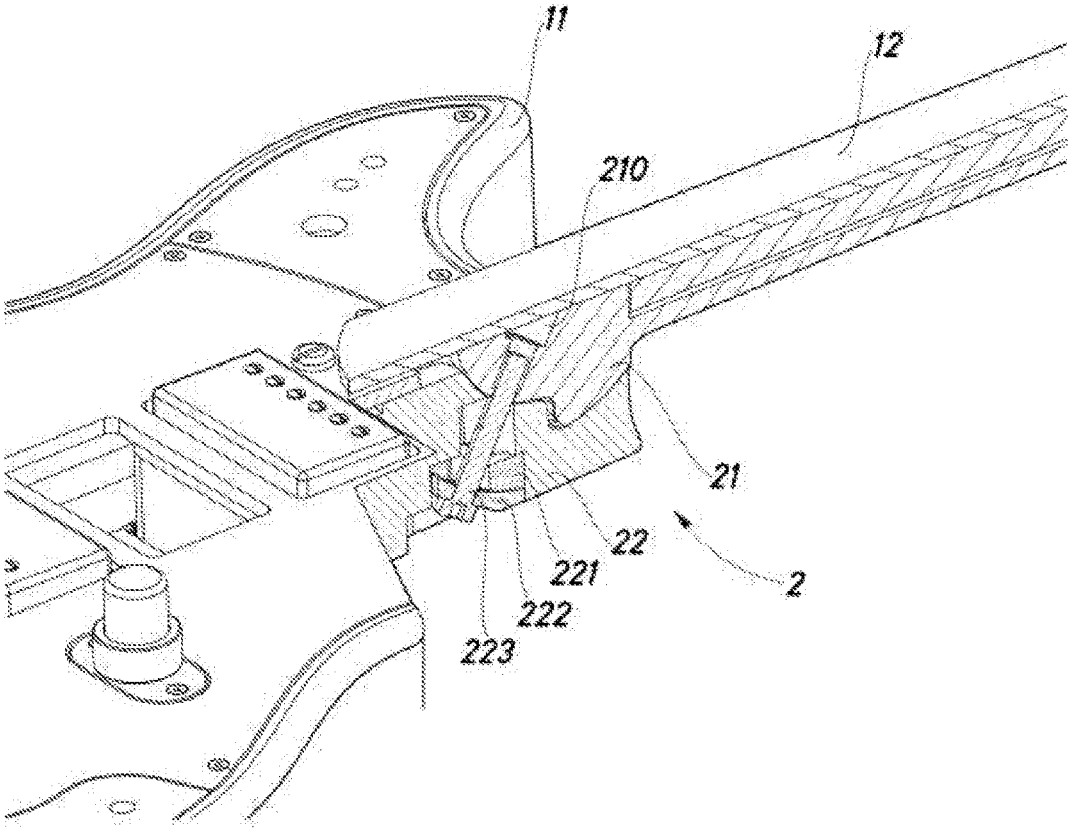
FIG. 3 is a partial cross section in perspective of a connection device according to the present invention.

FIGS. 3 to 6 show a first aspect of the present invention. In particular, FIG. 3 shows a first component 21 which may form part of the neck 12 or may be a separate component that can be connected to the neck 12 by means of at least one fixing component (not illustrated). FIG. 3 also shows a second component 22 which may form part of the body 11 of the guitar 1 or may be a separate component that can be connected to the body 11 by means of at least one fixing component (not illustrated). Both the first 21 and the second 22 connection components comprise respective surfaces that fit together and are connected to each other by means of a threaded fixing component 223 which among others may be a bolt, rod or stud, for example. Said fixing component 223 is inserted in a hole or orifice 210 arranged in the first component 21.

Figure 4:
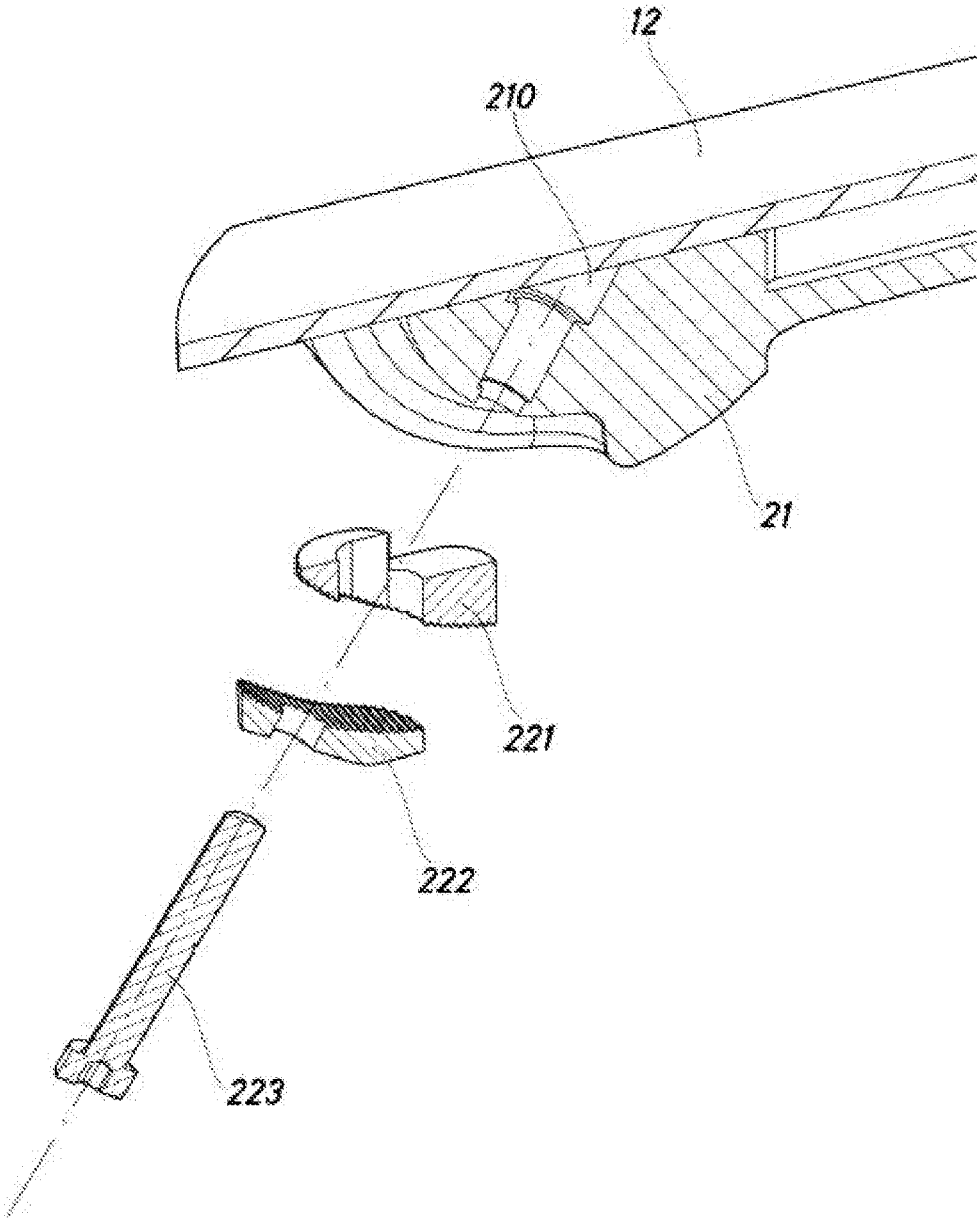
FIG. 4 is an exploded view of the connection device between the neck and body of a stringed musical instrument according to the present invention.

In addition, said second component 22, as can be seen in FIGS. 3 and 4, has a mechanism 2 for adjusting the angular position of the neck 12 relative to the body 11 of the guitar 1. Said adjustment mechanism 2 also comprises third 221 and fourth 222 components that each have respective curved surfaces that form-engage together. In addition, said third 221 and fourth 222 components comprise respective through-holes along which said threaded fixing component 223 is inserted until it is fixed in said hole or orifice 210 arranged in the first component 21.

Figure 5:
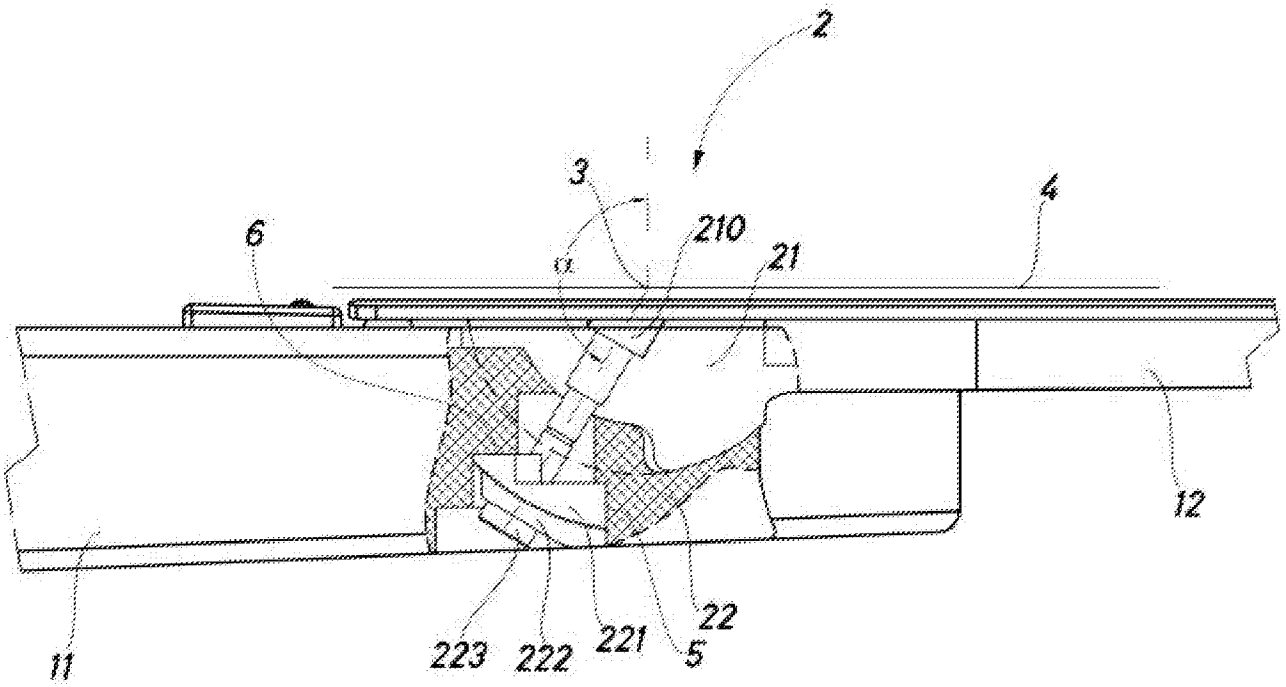
FIG. 5 is a side elevation view of the stringed musical instrument in which the connection device according to the present invention is illustrated in part allowing a first position between the neck and body of said stringed musical instrument.

As can be seen in FIG. 5, said third 221 and fourth 222 components are arranged inside the second component 22 in such a way that said third component 221 is locked and abuts the second component 22 at 5 and 6. The fourth component 222 can tilt relative to the third component 221 across the curved meshing fitted surface thereof.

Thus, the arrangement of the fourth component 222 relative to the third component 221 in FIG. 5 allows the neck 12 to be aligned with the body 11 of the guitar, in other words, there is no appreciable slope of the neck 12 relative to the body 11 of the guitar 1.

Figure 6:
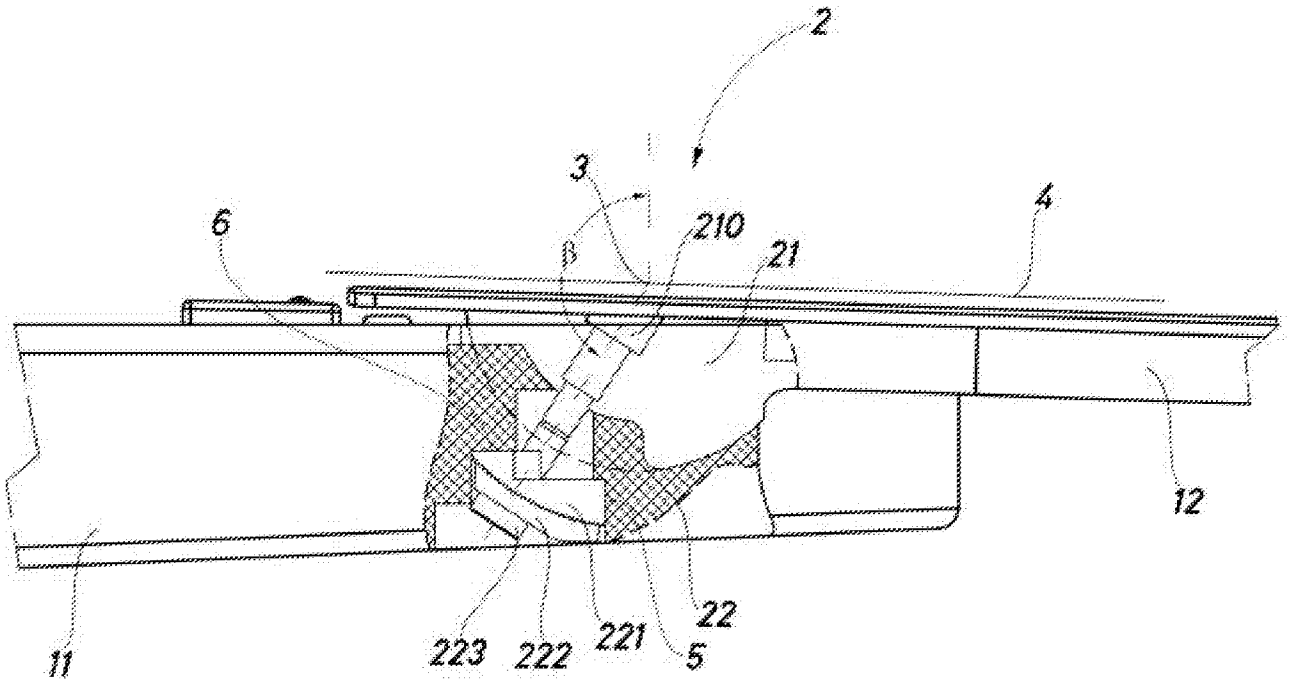
FIG. 6 is a side elevation view of the stringed musical instrument in which the connection device according to the present invention is illustrated in part, allowing a second position between the neck and body of said stringed musical instrument.

However, in FIG. 6, the fourth component 222 has tilted relative to the fitted meshing surface of the third component 221, thus allowing the first component 21 to tilt relative to the second component 22, or—which amounts to the same thing—allowing the neck 12 to slope relative to the body 11 of the guitar 1. It is important to emphasise that the centre of the turning circle of the first component 21 (and consequently of the neck 12) is always located at a point on the strings above the neck. Bridges 130 of different sizes can therefore be arranged on the guitar 1, and the neck can then be adjusted so that a constant distance of the strings is always maintained between the bridge (whatever the size or geometry thereof) and the centre 3 of the turning circle of the neck, as said centre 3 of the turning circle of the neck 12 is always located at a point that coincides with one of the strings 4 above the neck 12.

The tilting of the fourth component 222 relative to the third component 221 across a meshing surface allows the slope of the neck 12 relative to the body 11 to be gradually adjusted.

By using this mechanism 2 to adjust the neck 12 relative to the body 11 of the guitar 1, a guitarist can change the bridge 130 of the body 11 of the guitar 1 for other bridges of different geometries, providing a wide range of sounds that would not be possible on guitars of the prior art.

Therefore because the angular position of the neck 12 can be adjusted relative to the body 11 of the musical instrument, various sizes of bridges become available while always maintaining the strings at a constant distance between the bridge and the centre 3 of the turning circle of the neck 12.

Figure 1:
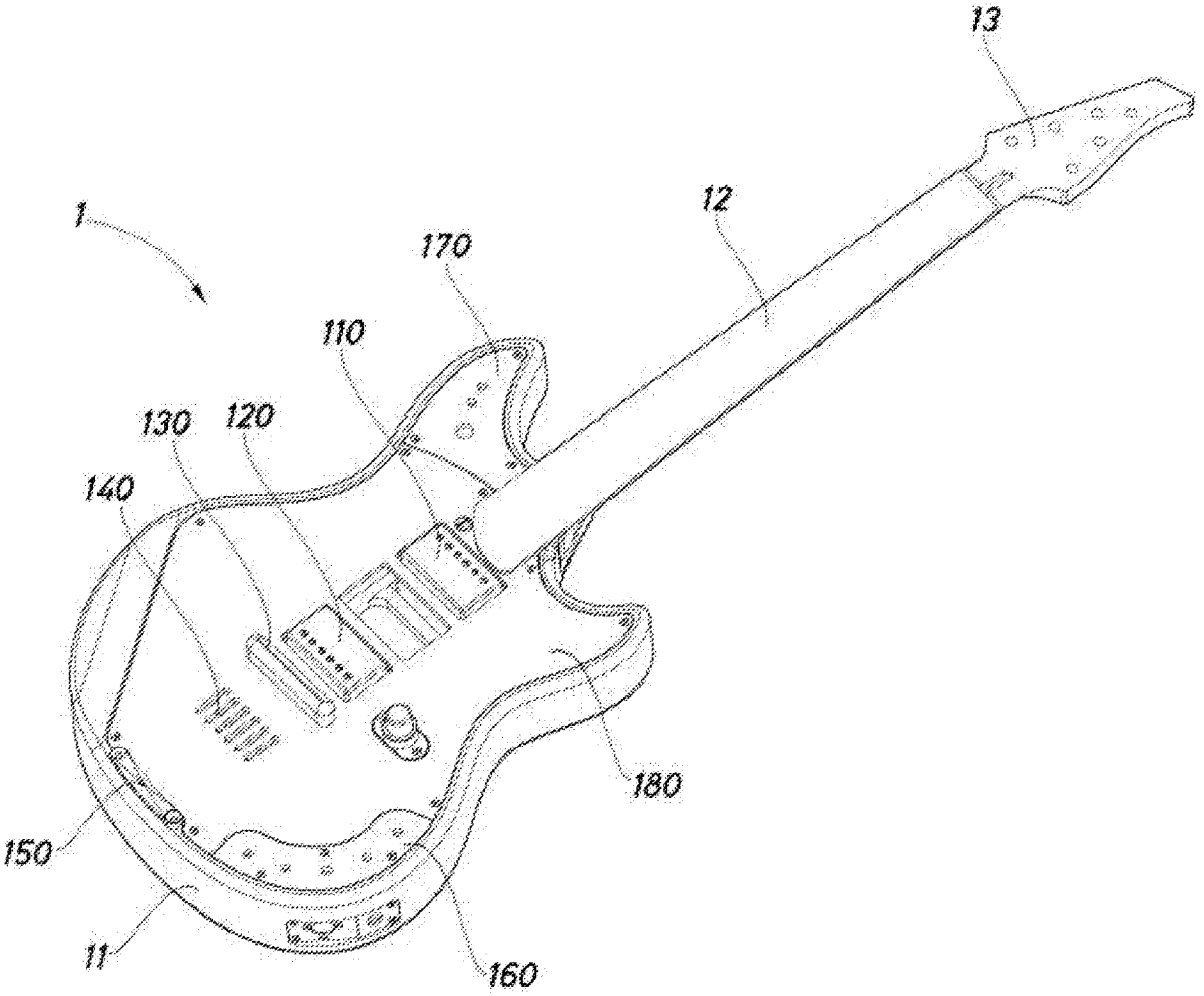
FIG. 1 is a perspective view of the top or front portion of a stringed musical instrument (in which the strings are not shown), the body and neck of which are connected by a connection component according to the present invention.
Figure 2:
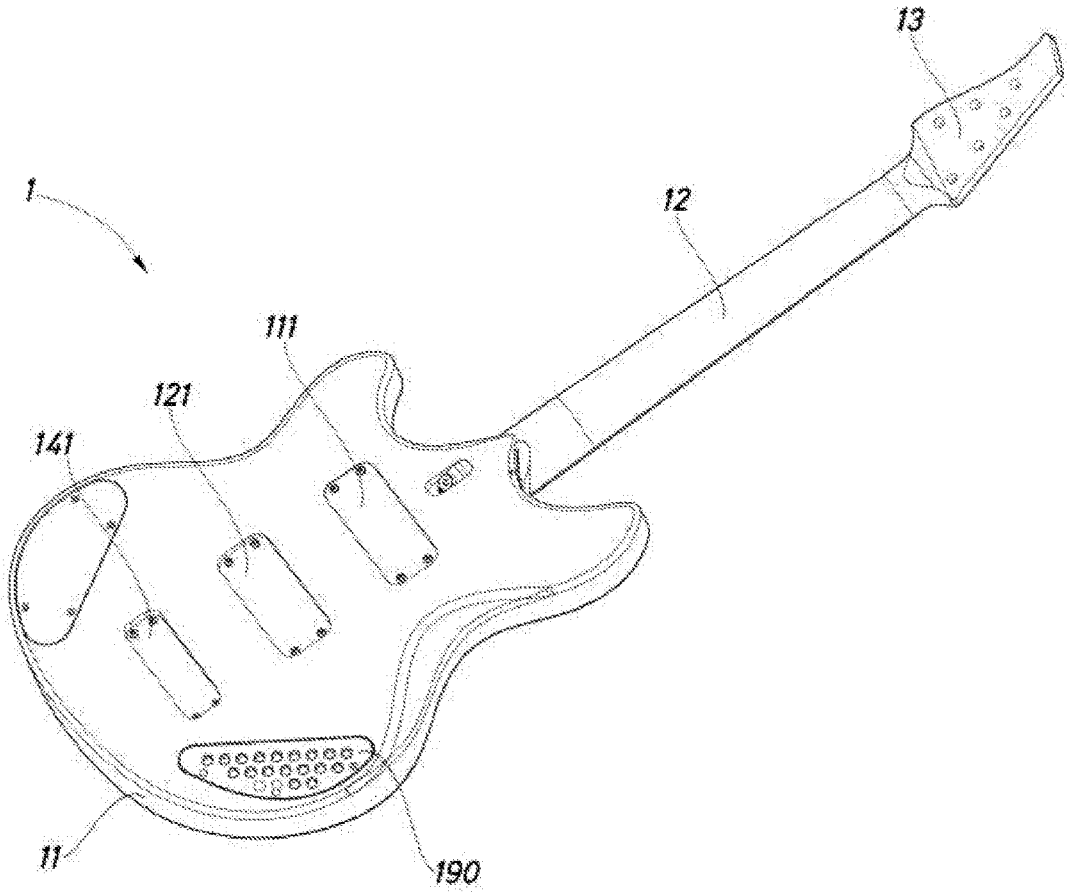
FIG. 2 is a perspective view of the bottom or back portion of a stringed musical instrument, the body and neck of which are connected by a connection device according to the present invention.
Figure 7:
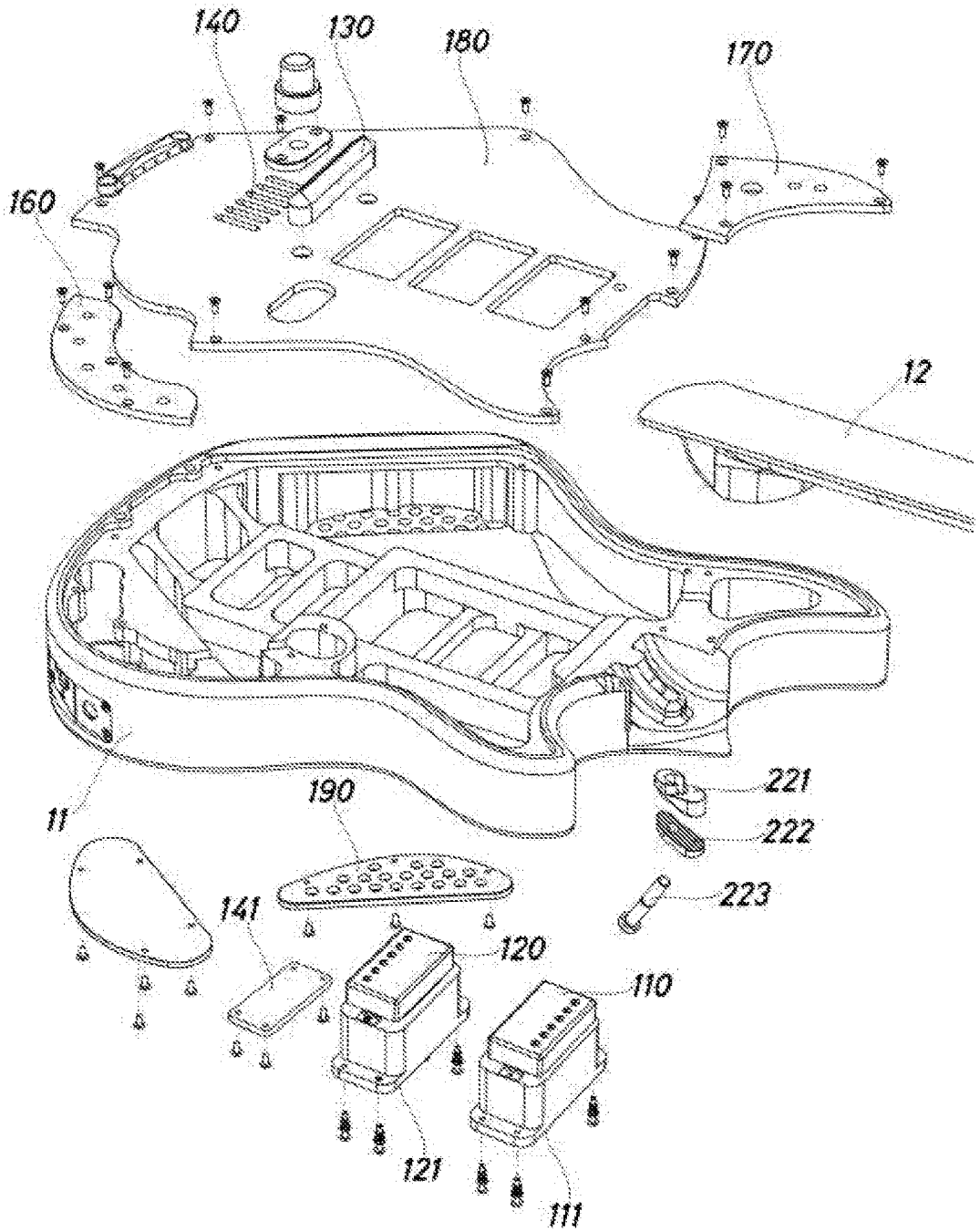
FIG. 7 is an enlarged exploded view of some components of said stringed musical instrument, not showing the strings.

In addition, as can be seen in FIGS. 1, 2 and 7, the guitar 1 may consist of a body 11 with various interchangeable portions of different materials such as maple, mahogany or pine wood, among others. For example, the same neck can be interchanged with boxes of different materials, such as corrosion-resistant metal, aluminium or brass, among others. Said body 11 may also be made of carbon fibre. Manufacturing said body 1 in various materials allows exploration of the different effects and sounds said materials may create in producing the sound of the guitar 1.

Said body 11 may comprise a top cover 180, also known as the harmonic cover which can easily be interchanged simply by slackening the strings thereof. The strings of the guitar may be fixed to the body 11 of the guitar at two different positions also known as tailpieces (140, 150): to a first inner tailpiece 140 allowing a more acute angle of the strings relative to the bridge 130 or a second outer tailpiece 150 which allows a flatter angle of the strings relative to the same bridge 130. To arrange the strings inside the first inner tailpiece 140, a hollow can be made in the bottom portion of the body 11 of the guitar 1 and said hollow can then be closed with a cover 141.

In addition, the front portion of the body 11 of the guitar 1 may also comprise different covers (170, 160) with holes to provide a different sound.

As can be seen in 2 and 7, the electromagnetic transducers or chips (110, 120), also known as pickups, can be interchanged and removed through the back portion of the body 11 of the guitar 1. Said pickups (110, 120) can be inserted easily through the back portion of the body 11 of the guitar 1 without having to slacken or remove the strings of the guitar 1. Once inserted through the back portion of the body 11 of the guitar 1, said pickups (110, 120) are fixed by means of the respective support (111, 121) with screws.

Furthermore, the back portion of the body 11 of the guitar 1 may also comprise different covers (190) with holes to provide a different sonority.

Although the invention has been described with respect to preferred embodiments, these should not be considered as limiting the invention, which is defined by the widest interpretation of the following claims.

What is claimed is:

1. A device for connecting the neck to the body of a stringed musical instrument comprising:

a first component, and a second component, which are configured to connect said first component to the neck and said second component to the body of the stringed musical instrument, wherein the first component and the second component are slidably fit each other at a contact surface thereof, means for adjusting the contact position of said first component relative to said second component to different angles, and means for fixing the relative position of said first component to said second component, wherein:

said adjustment means of the respective first and second components each have curved toothed contact surfaces that form-engage to each other, said adjustment means comprise two parts with respective curved toothed contact surfaces that fit together arranged inside said second component, both of the parts comprise at least one through-hole along which at least one fixing component is arranged, and the distal end of which is attached to said first component.

2. The device for connecting the neck to the body of a stringed musical instrument according to claim 1, wherein said fixing means comprise at least one bolt-type threaded component.

3. The device for connecting the neck to the body of a stringed musical instrument according to claim 1, wherein said fixing component comprises at least one bolt-type threaded component.

4. A device for connecting the neck to the body of a stringed musical instrument comprising:

a first component, and a second component, which are configured to connect said first component to the neck and said second component to the body of the stringed musical instrument, wherein the first component and the second component are slidably fit each other at a contact surface thereof, means for adjusting the contact position of said first component relative to said second component to different angles, and means for fixing the relative position of said first component to said second component, wherein the contact surface of the first component and the second component comprises a circular-arc curved surface having a curvature center thereof at a point on the strings of said musical instrument.

5. A stringed musical instrument comprising a box connected to a neck by the device for connecting the neck to the body of a stringed musical instrument according to claim 1.

6. The stringed musical instrument according to claim 5, wherein said stringed musical instrument is a guitar.

7. A device for connecting the neck to the body of a stringed musical instrument comprising:

a first component, and a second component, which are configured to connect said first component to the neck and said second component to the body of the stringed musical instrument and be form-engaged to each other, means for adjusting the contact position of said first component relative to said second component to different angles, and means for fixing the relative position of said first component to said second component, wherein said adjustment means of the respective first and second components each have curved toothed contact surfaces that form-engage to each other, wherein:

said adjustment means comprise two parts with respective curved toothed contact surfaces that fit together arranged inside said second component, both of the parts comprise at least one through-hole along which at least one fixing component is arranged, and the distal end of which is attached to said first component.

8. The device for connecting the neck to the body of a stringed musical instrument according to claim 7, wherein said fixing means comprise at least one bolt-type threaded component.

9. The device for connecting the neck to the body of a stringed musical instrument according to claim 7, wherein said fixing component comprises at least one bolt-type threaded component.

10. A stringed musical instrument comprising a box connected to a neck by the device for connecting the neck to the body of a stringed musical instrument according to claim 7.

11. The stringed musical instrument according to claim 10, wherein said stringed musical instrument is a guitar.

12. A device for connecting the neck to the body of a stringed musical instrument, comprising:

a first component, and a second component, which are configured to connect said first component to the neck and said second component to the body of the stringed musical instrument and be form-engaged to each other, means for adjusting the contact position of said first component relative to said second component to different angles, and means for fixing the relative position of said first component to said second component, wherein the contact surface of the first component and the second component comprises a circular-arc curved surface having a curvature center thereof at a point on the strings of said stringed musical instrument.

* * * * *